US007510437B2

(12) United States Patent
Wu

(10) Patent No.: US 7,510,437 B2
(45) Date of Patent: Mar. 31, 2009

(54) ELECTRICAL CONNECTOR WITH SHEET CONTACT

(75) Inventor: Jian-Feng Wu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/002,742

(22) Filed: Dec. 18, 2007

(65) Prior Publication Data

US 2008/0146087 A1 Jun. 19, 2008

(30) Foreign Application Priority Data

Dec. 18, 2006 (CN) ..... 2006 1 0166437

(51) Int. Cl.
*H01R 13/00* (2006.01)

(52) U.S. Cl. ..... 439/581; 439/607

(58) Field of Classification Search ..... 439/578–581, 439/63, 607
See application file for complete search history.

(56) References Cited

U.S. PATENT DOCUMENTS

| | | | | |
|---|---|---|---|---|
| 4,598,961 | A * | 7/1986 | Cohen | 439/63 |
| 5,326,280 | A * | 7/1994 | Briones et al. | 439/581 |
| 5,662,481 | A * | 9/1997 | Wright | 439/63 |
| 6,932,614 | B1 * | 8/2005 | Kan | 439/580 |
| 2004/0018772 | A1 * | 1/2004 | Zhang et al. | 439/607 |
| 2005/0048847 | A1 | 3/2005 | Hsieh | |

* cited by examiner

*Primary Examiner*—Hien Vu
(74) *Attorney, Agent, or Firm*—Wei Te Chung

(57) ABSTRACT

An electrical connector (100) comprises an insulative housing (1) defining a receiving cavity (101) for being inserted with a mating connector, a receiving groove (14) and a sheet contact (5). The sheet contact comprises a base portion (50) retained in the receiving groove, a spring contacting portion (51) extending into the receiving cavity from the base portion for contacting with the mating connector, and a soldering leg (53) and a retaining leg (52) extending from a same side of the base portion and out of the housing.

10 Claims, 5 Drawing Sheets

ELECTRICAL CONNECTOR WITH SHEET CONTACT

BACKGROUND OF THE INVENTION

1. Field of the Invention

The present invention relates to an electrical connector with a sheet contact.

2. Description of Related Art

US Pat. Pub No. 2005/0048847 discloses a conventional power connector, which includes an insulative housing, a central columnar contact received in the housing, a grounding contact received in the housing, a U-shaped metal shell covering the housing. The central contact, grounding contact and metal shell are connecting with a printed circuit board (PCB) by their legs being soldered to the PCB, namely, soldered by surface mounting technology (SMT). However, the surface soldering legs will be easily destroyed so that the electrical connector may be off from the circuit board easily.

Hence, an improved electrical connector is desired to overcome above problem.

SUMMARY OF THE INVENTION

An object of the present invention is to provide an electrical connector which is connected to a PCB steadily.

In order to achieve above-mentioned object, an electrical connector comprises an insulative housing defining a receiving cavity for being inserted with a mating connector, a receiving groove and a sheet contact. The sheet contact comprises a base portion retained in the receiving groove, a spring contacting portion extending into the receiving cavity from the base portion for contacting with the mating connector, and a soldering leg and a retaining leg extending from a same side of the base portion and out of the housing.

Other objects, advantages and novel features of the present invention will become more apparent from the following detailed description of the present embodiment when taken in conjunction with the accompanying drawings.

DETAILED DESCRIPTION OF THE INVENTION

Figure 1:
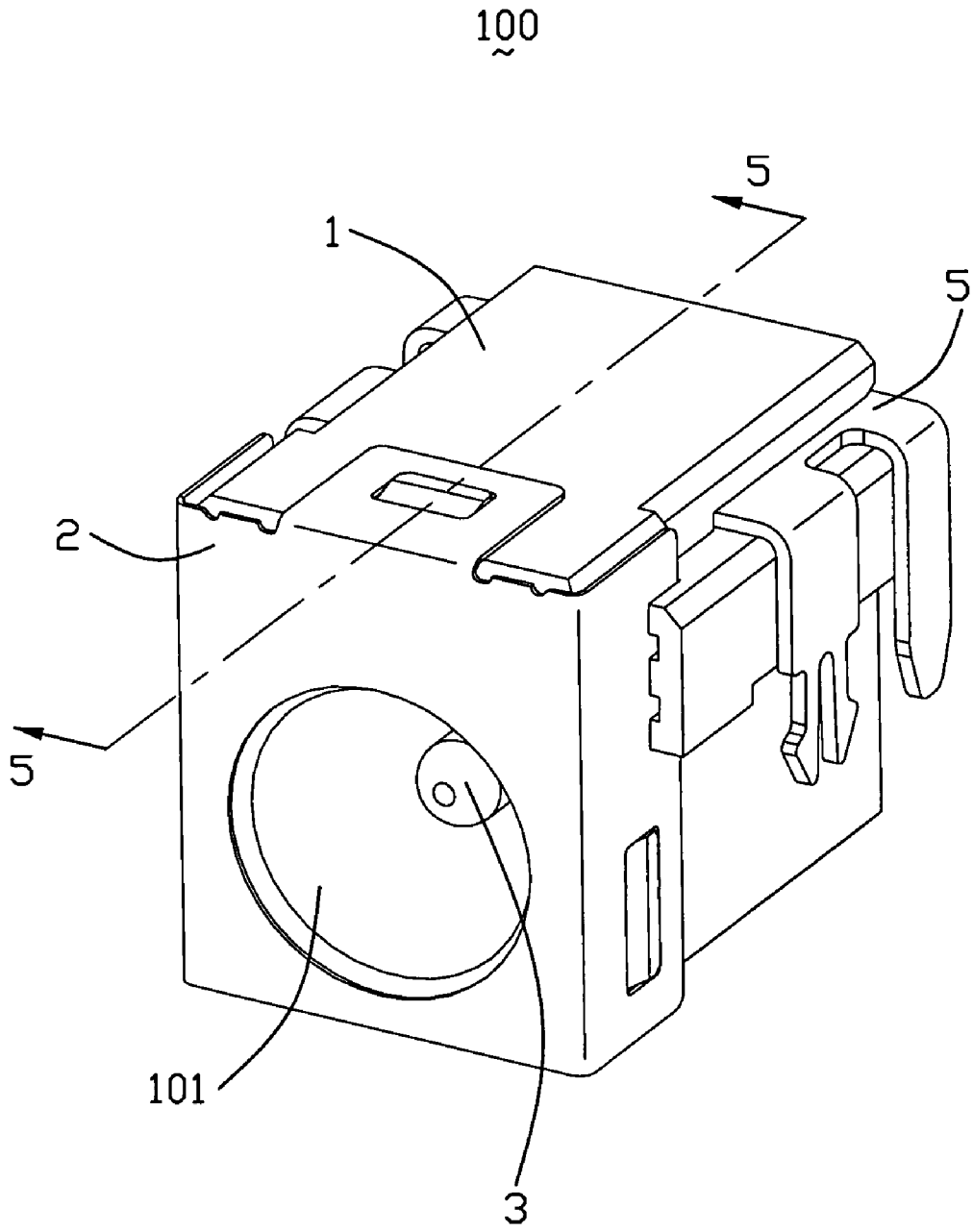
FIG. 1 is a front assembled perspective view of an electrical connector in accordance with the present invention.

Reference will now be made to the drawing figures to describe a preferred embodiment of the present invention in detail.

Figure 2:
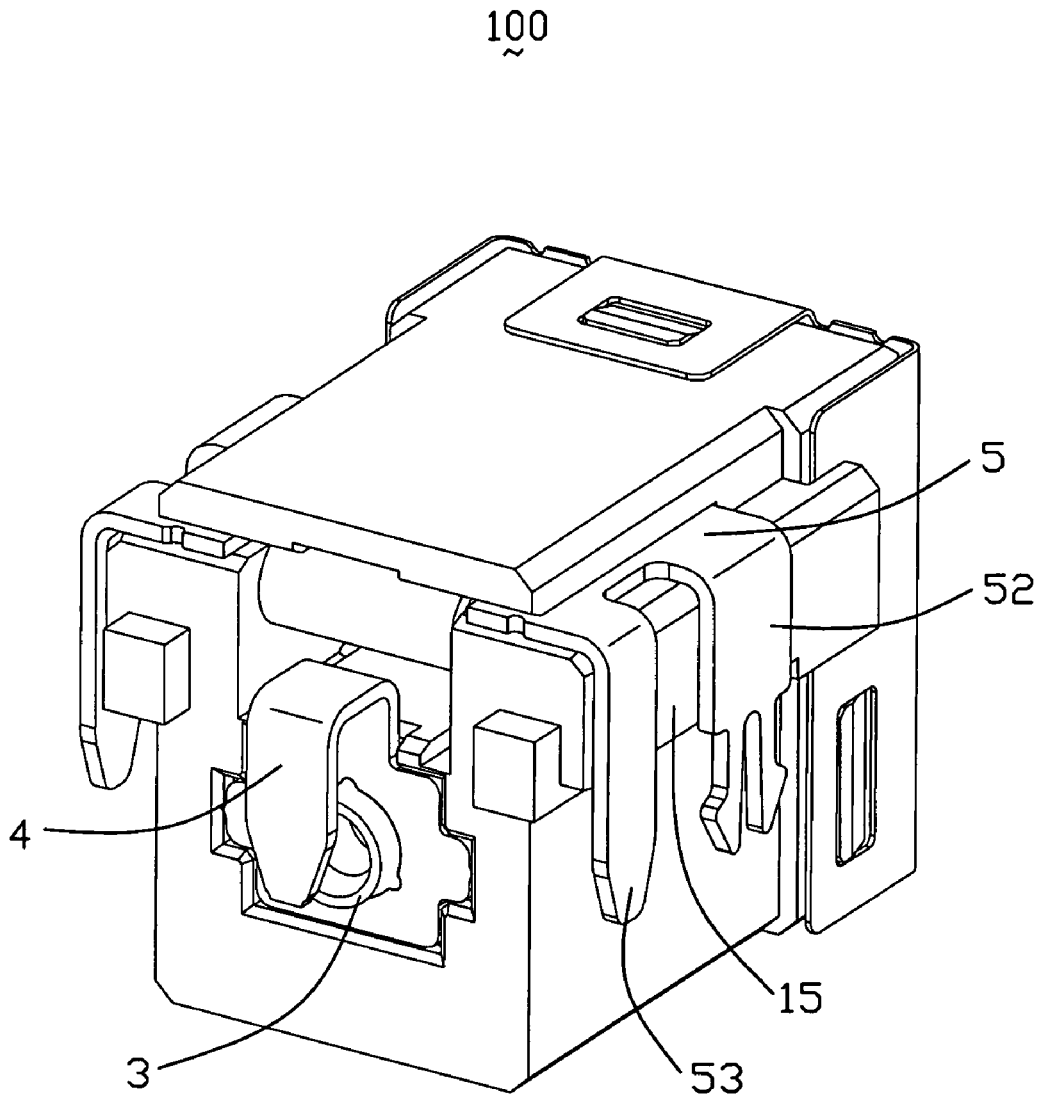
FIG. 2 is a rear assembled perspective view of the electrical connector of FIG. 1.

Referring to FIGS. 1 and 2, an electrical connector 100 in accordance with the present invention mainly comprises an insulative housing 1, a shield 2 covering a front portion of the housing 1, a central columnar contact 3 received in the housing 1, a retaining member 4 retained in a back portion of the central contact 3 and a sheet contact 5.

Figure 3:
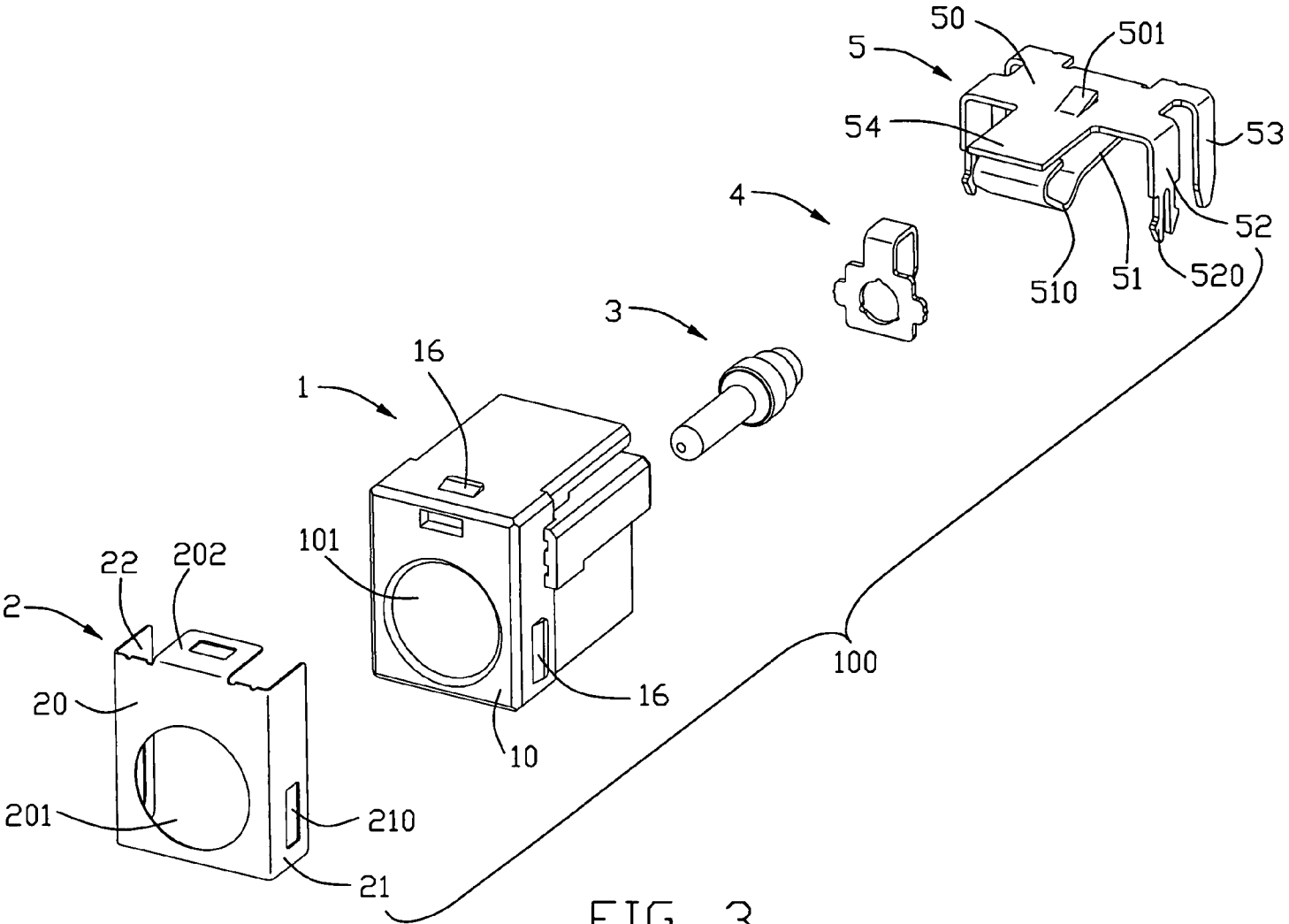
FIG. 3 is a front exploded perspective view of the electrical connector of FIG. 1.
Figure 4:
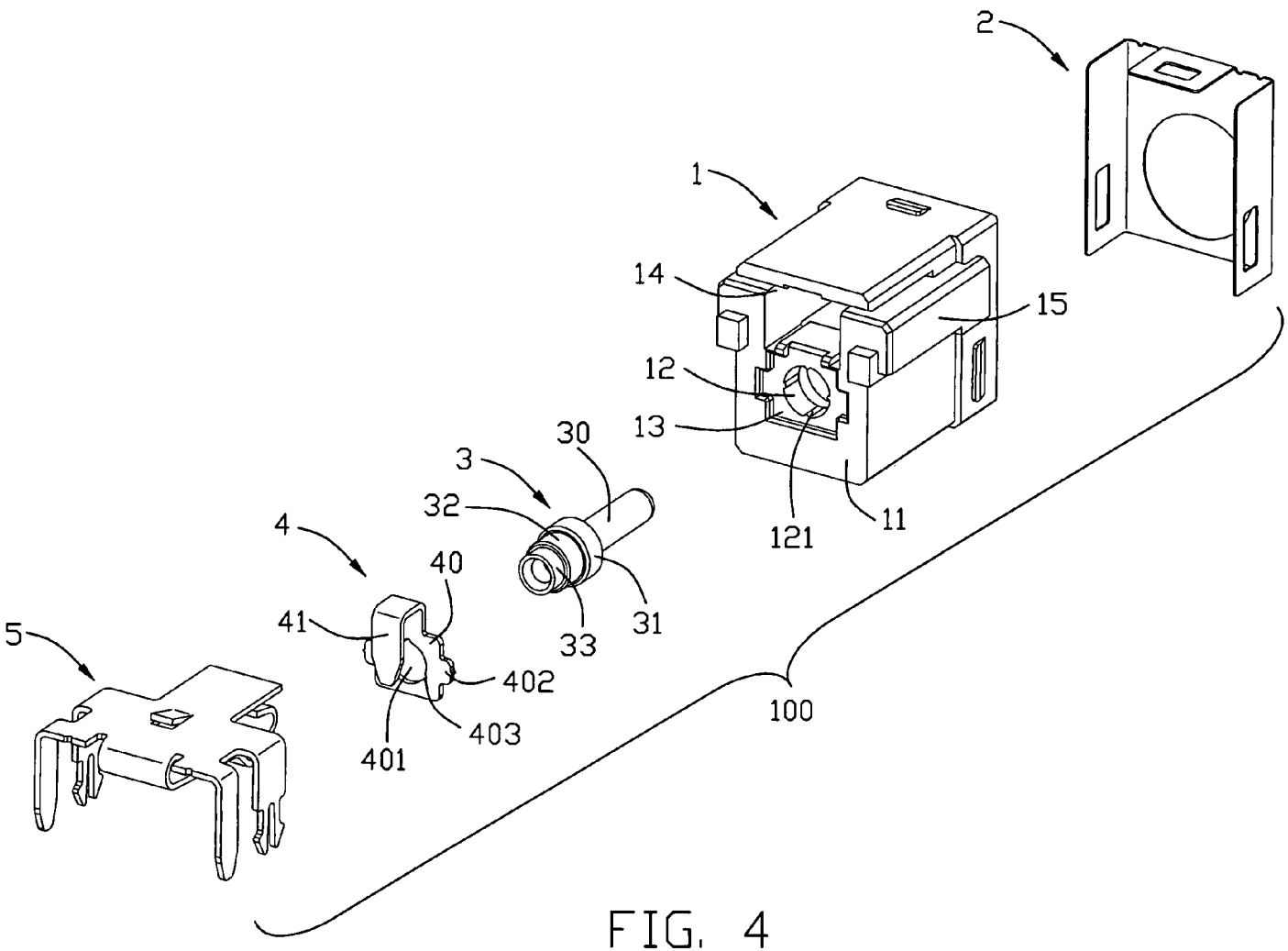
FIG. 4 is a rear view of the electrical connector of FIG. 3.

Referring to FIGS. 3 and 4, the housing 1 in a substantial-cubical shape has a front face 10 and a rear face 11 opposite to the front face 10. The housing 1 defines a tube-like receiving cavity 101 through the front face 10, therefor an insertion of a complementary connector. The receiving cavity 101 further extends rearwardly in a smaller diameter through the rear face 11 of the housing 10 to define a retaining hole 12 and a shallow cavity 13 is defined on the rear face 11 surrounding the retaining hole 12. A receiving groove 14 is defined adjacent the top of the housing 1 and recessed forwards from the rear face 11 of the housing 1 and a back portion of the receiving groove 14 is running through two opposite sidewalls of the housing 1, thereby the housing 1 are divided into an upper portion and a lower portion with a supporting portion 15 at each side thereof.

The shield 2 includes a base portion 20 with a hole 201 corresponding the receiving cavity 101 and a pair of sidewalls 21, 22 extending rearwardly from the base portion 20. A top wall 202 bents rearwardly from the top edge of the base portion 20. The shield 2 is retained on the housing 1 by engaging portions 210 respectively in the top wall 202 and the sidewalls 21, 22 interlocking with the corresponding protrusions 16 respectively defined on the top surface and two sidewalls of the housing 1.

Figure 5:
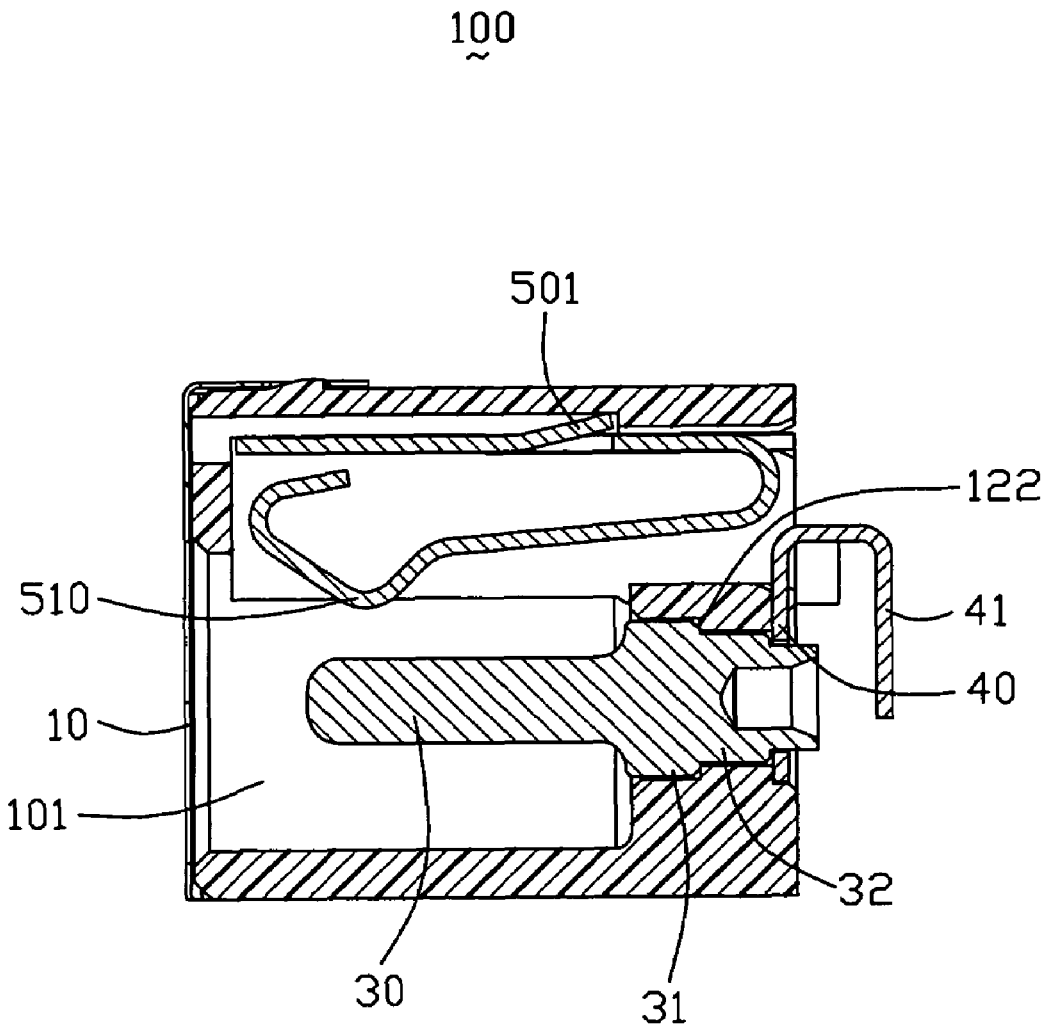
FIG. 5 is a cross-sectional view of FIG. 1 taken along line 5-5.

Referring to FIGS. 4 and 5, the central contact 3 comprises a contacting portion 30 for engaging with the complementary connector (not shown), a first engaging portion 31, a second engaging portion 32 with smaller diameter than the first engaging portion 31 and a connecting portion 33 with smaller diameter than the second engaging portion 32. The contacting portion 30, the first engaging portion 31, the second engaging portion 32 and the connecting portion 33 are of column shapes, and the contacting portion 30 has the smallest diameter than other portions of the central contact 3. When the central contact 3 is inserted into the receiving cavity 101 from the front face 10 of the housing 1, the first and second engaging portion 31, 32 are retained in the retaining hole 12 and interferes with a plurality of ribs 121 defined in the retaining hole 12 in the front-to-back direction. A step portion 122 (as shown in FIG. 5) in the retaining hole 12 blocks the first engaging portion 31, which will prevent the central contact 3 from moving backwards. The connecting portion 33 protrudes out of the housing 1.

The retaining member 4 defines a retaining portion 40 and a connecting portion 41 extending upwards and then downwards from the retaining portion 40. The retaining portion 40 defines a retaining hole 401 in the center with several slits 403 at inner an edge and a pair of wings 402 at the right and left edges. The retaining hole 401 is receiving and interferely engaging with the connecting portion 33. Parts of the outer surface of the connecting portion 33 is forced into the slits 403 by tractile of metal so as to prevent the central contact 3 from rotating relative to the retaining member 4. The wings 402 engage with the housing 1 to prevent the retaining member 4 from shaking and ensure the connecting portion 41 to be soldered on the circuit board exactly.

Referring to FIGS. 3 and 5, the sheet contact 5 is defined as a grounding contact in the preferred embodiment. The grounding contact 5 defines a base portion 50, a spring contacting portion 51 extending downwards and then forwards from the back edge of the base portion 50, a retaining leg 52 and a soldering leg 53 extending downwards from every side of the base portion 50 and a projecting portion 54 extending flatly and forwards from the front edge of the base portion 50. The base portion 50 defines a tab 501 stamped upwards. The spring contacting portion 51 is slant downwards into the receiving cavity 101 and defines a curved portion 510 near the front face 10 to mate with the complementary connector. The retaining leg 52 is parallel to the soldering leg 53 and defines a pair of hooked feet 520 at the bottom free end with a slot therebetween. The base portion 50 and the projecting portion 54 of the grounding contact 5 are received and retained in the receiving groove 14. The tab 501 blocks the housing 1 to prevent the grounding contact 5 from moving outwards. The retaining leg 52 and the soldering leg 53 extend out of the housing 1 and are supported by the supporting portion 15.

The pair of hooked feet 520 are locking with the corresponding holes defined in the PCB to retain the electrical connector 100 steadily, the retaining leg 52 also can be soldered in the PCB.

However, the disclosure is illustrative only, changes may be made in detail, especially in matter of shape, size, and arrangement of parts within the principles of the invention. For example, the sheet contact 5 also can be defined as a signal contact.

What is claimed is:

1. An electrical connector comprising:

an insulative housing defining a receiving cavity for receiving a mating connector and a receiving groove at an end opposite with the receiving cavity; and a sheet contact comprising a base portion having a tab retained in the receiving groove, a spring contacting portion extending into the receiving cavity from the base portion for contacting with the mating connector, and a soldering leg and a retaining leg extending from a same side of the base portion and out of the housing;

wherein the spring contacting portion extends downwardly and forwardly from the base portion;

wherein the base portion comprises a projecting portion extending horizontal and forwardly from a front edge;

wherein the receiving groove extends through two opposite sides of the housing at a back portion thereof and the retaining legs and the soldering legs extend out of the receiving groove; and wherein the electrical connector further comprises a central contact with its one end extending into the receiving cavity for mating with the mating connector and the other end connecting to a printed circuit board by a retaining member having a connecting leg.

2. The electrical connector as described in claim 1, wherein the retaining leg is in line with the soldering leg.

3. The electrical connector as described in claim 1, wherein the retaining leg defines two hooked feet at a free end thereof with a slot therebetween.

4. The electrical connector as described in claim 1, wherein each retaining leg and soldering leg is supported by a supporting portion provided at each sidewall of the housing.

5. The electrical connector as described in claim 1, wherein the retaining member comprises a retaining hole with slits at an inner edge thereof, the central contact is received in the retaining hole with its parts forced into the slits.

6. An electrical connector comprising:

an insulative housing defining a receiving cavity for receiving a mating connector and a receiving a groove at an end opposite with the receiving cavity;

a tubular center contact assembled to the housing rearwardly with a step abutting against a corresponding shoulder of the housing for preventing further rearward movement, said tubular center contact disposed in the receiving cavity;

a retaining member assembled to a rear face of the housing and defining a retention hole grasping a tail of said center contact for preventing not only forward movement of the center contact but also rearward movement of the retaining member, said retaining member further including a connecting leg essentially located behind the retention hole at a same level; and a grounding contact having a tab and being assembled in the receiving groove of the housing with a grounding tang extending into the receiving cavity;

wherein said grounding contact includes a pair of soldering legs by two sides of the housing under a condition that the connecting leg of the retaining member and the soldering legs of the grounding contact are essentially located at said same level;

wherein the receiving groove extends through two opposite sides of the housing at a back portion thereof and the soldering legs extend out of the receiving groove.

7. The electrical connector as claimed in claim 6, wherein said grounding contact is assembled to the housing from said rear face.

8. The electrical connector as claimed in claim 7, wherein said grounding tang is located in front of the retaining member.

9. The electrical connector as claimed in claim 8, wherein said grounding tang and said retaining member are overlapped with each other in a front-to-back direction.

10. An electrical connector comprising:

an insulative housing defining a receiving cavity for receiving a mating connecter and a receiving groove at an end opposite with the receiving cavity;

a tubular center contact assembled to the housing rearwardly with a step abutting against a corresponding shoulder of the housing for preventing further rearward movement, said center contact disposed in the receiving cavity;

a retaining member assembled to a rear face of the housing and connected to the center contact; and a grounding contact having a tab and being assembled in the receiving groove of the housing from said rear face with a grounding tang extending into the receiving cavity; wherein said grounding tang and the retaining member are overlapped with each other in a front-to-back direction so as to require said grounding contact to be first assembled to the housing before said retaining member is assembled to the housing;

wherein said retaining member defines a retaining portion with a retaining hole fastened to the center contact, and a connecting leg essentially locate right behind said retaining portion in said front-to-back direction;

wherein said grounding contact includes a pair of soldering legs by two sides of the housing under a condition that the connecting leg of the retaining member and the soldering legs of the grounding contact are essentially located at said same level;

wherein the receiving groove extends through two opposite sides of the housing at a back portion thereof and the soldering legs extend out of the receiving groove.

* * * * *